US005328665A

United States Patent [19]

Geiger

[11] Patent Number: 5,328,665

[45] Date of Patent: Jul. 12, 1994

[54] METHOD AND APPARATUS FOR CONTROLLING A COMBUSTION PROCESS

[75] Inventor: Allen R. Geiger, Las Cruces, N. Mex.

[73] Assignee: LaSen, Inc, Las Cruces, N. Mex.

[21] Appl. No.: 935,530

[22] Filed: Aug. 25, 1992

[51] Int. Cl.[5] ..... F02P 23/00

[52] U.S. Cl. ..... 422/105; 123/143 B; 123/536

[58] Field of Search ..... 123/143 B, 143 R, 536, 123/537, 538; 60/39.401; 431/258, 1; 422/105

[56] References Cited

U.S. PATENT DOCUMENTS

| | | | |
|---|---|---|---|
| 4,314,530 | 2/1982 | Giacchetti | 123/143 R |
| 4,416,226 | 11/1983 | Nishida et al. | 123/143 B |
| 4,434,753 | 3/1984 | Mukainakano et al. | 123/143 B |
| 4,523,552 | 6/1985 | Mukainakano et al. | 123/143 B |
| 4,556,020 | 12/1985 | Hickling | 123/536 |
| 4,726,336 | 2/1988 | Hoppie et al. | 123/537 |
| 4,852,529 | 8/1989 | Vowles | 123/143 R |
| 4,947,640 | 8/1990 | Few et al. | 431/258 |

FOREIGN PATENT DOCUMENTS

| | | | |
|---|---|---|---|
| 1236561 | 6/1971 | United Kingdom | 123/143 B |
| 1360196 | 7/1974 | United Kingdom | 123/143 B |

OTHER PUBLICATIONS

Christopher A. Jacobs, Ph.D., E.E., "The Doctor's Step-By-Step Guide to Optimizing Your Ignition", Dec. 1986, Jacobs Technical Publications, 3327 Verdugo Rd., Los Angeles, Calif., 90065, pp. 10-11.

*Primary Examiner*—Tony M. Argenbright
*Assistant Examiner*—M. Macy
*Attorney, Agent, or Firm*—Kramer, Brufsky & Cifelli

[57] ABSTRACT

In an apparatus and method for controlling a combustion process, the output of an optical parametric oscillator/laser (OPOL) is directed into the combustion chambers of an internal-combustion engine to initiate combustion of an air/fuel mixture. A control unit controls the output of the OPOL to emit a wavelength of radiation within a region of absorption of the molecules of the air/fuel mixture in order to induce those molecules into a state of excitation to ignite the mixture. The exact wavelength of the OPOL is selected based on the type of fuel and the compression ratio of the engine. A cylinder-firing-control (CFC) unit is responsive to signals transmitted by the control unit to direct the output of the OPOL to selected cylinders of the engine. And a sensor is mounted on the engine for transmitting signals to the control unit indicative of the rotational position of the engine, and the control unit controls the firing of the OPOL based on these signals.

31 Claims, 5 Drawing Sheets

METHOD AND APPARATUS FOR CONTROLLING A COMBUSTION PROCESS

FIELD OF THE INVENTION

The present invention relates to methods and apparatus for controlling combustion processes and, more particularly, to methods and apparatus for controlling combustion processes by photo-excitation of the fuel and/or oxidant.

BACKGROUND INFORMATION

In a typical internal-combustion engine a camshaft controls the timing of the valves relative to the movement of the corresponding pistons. A distributor in turn controls the actuation of spark plugs, which introduce electrical sparks into the combustion chambers of the pistons to ignite an air/fuel mixture to drive the pistons. The true ignition point of the air/fuel mixture is marked by a combustion process called flaggregation (i.e., at the instant flaggregation occurs, true ignition begins).

The flaggregation of each cylinder in an internal-combustion engine is typically not maintained at a constant rate, and can vary anywhere within the range of approximately 20 to 60 meters/second. The faster the rate of flaggregation, the more easily combustion can take place during a typical engine cycle. One reason for slow flaggregation, however, is that the probability of chemical combustion around the spark plug at the instant that a spark occurs is relatively poor. Accordingly, there is a great degree of variability in flaggregation among internal-combustion engines.

In tests of internal-combustion engines, the same cylinder typically does not produce the same pressure in consecutive firings. One reason for this pressure variation is that the probability of combustion in two firings is almost never the same. In order for true ignition to occur, the fuel and oxygen molecules in a combustion chamber must reach a threshold state of vibrational excitation and then burn with sufficient energy to maintain a self-sustaining combustion. In current internal-combustion engines this threshold state of vibrational excitation is obtained during the compression stroke of the piston. It is this group of molecules that reach the threshold level of vibrational excitation which produce the resulting self-sustaining burn to carry out the combustion process. However, because these excited states are obtained by thermal collisions of the molecules of the air-fuel mixture, the distribution of excited states of the molecules generally follows a Boltzmann distribution. Thus, at the initiation of ignition, it is believed that typically less than approximately 30% of the available combustible molecules reach the threshold state of vibrational excitation. Accordingly, it is also believed that flaggregation occurs relatively slowly at least approximately 70% of the time in typical internal-combustion engines.

One method of increasing the rate of flaggregation is to increase both the octane of the fuel and the compression ratio of the engine. By increasing the compression ratio of the engine, the probability that the various molecules of the air/fuel mixture will reach the threshold level of vibrational excitation is increased. However, because air contains nitrogen, various $NO_x$ compounds are formed under such high compression. Accordingly, high-octane/high-compression engines have been eliminated for all practical purposes for failure to meet pollution standards because of the formation of $NO_x$.

In an attempt to make low-compression engines burn more efficiently, multiple-spark discharges have been used. Although multiple-spark discharges have been known to better facilitate the burn efficiency of high-compression engines, such modifications can also cause low-compression engines to achieve flaggregation rates similar to high-compression engines. However, only the initial spark, i.e., the spark at the front of the flame, requires the multiple discharge, and it is difficult to control such a system so that the multiple discharge occurs in this way. Also, because of the energy distribution of the electrons in the spark discharges, most of the electrons do not excite the molecules of the air-fuel mixture to the threshold level of vibrational excitation. Accordingly, this is a relatively inefficient means for increasing the rate of flaggregation.

SUMMARY OF THE INVENTION

The present invention is directed to an apparatus for controlling a combustion process, comprising a laser source including an output coupled to at least one combustion chamber for directing radiation into the at least one combustion chamber to initiate combustion of a fuel mixture within the combustion chamber. A control unit is coupled to the laser source for controlling an output of the laser source to emit at least one predetermined wavelength of radiation corresponding to a region of absorption of at least one molecule of the fuel mixture. The laser source thus induces a plurality of those molecules into a state of excitation to ignite the fuel mixture.

One embodiment of the present invention further comprises a beam-directing unit coupled between the output of the laser source and the at least one combustion chamber for directing the radiation into the combustion chamber. The apparatus of the present invention may be coupled to a plurality of combustion chambers, and the beam-directing unit may include a liquid-crystal switch for directing the radiation to a selected combustion chamber by adjusting the refractive index of the liquid-crystal switch.

In one embodiment of the present invention, the liquid-crystal switch includes a plurality of electrodes and the refractive index of the liquid-crystal switch is adjusted by directing a voltage to a predetermined set of electrodes. A switching circuit is preferably coupled between the control unit and the liquid-crystal switch for directing the voltage to the predetermined set of electrodes. A voltage driver can also be coupled to the switching circuit for supplying the voltage to the predetermined set of electrodes.

One embodiment of the present invention further comprises at least one fiber-optic cable coupled between the beam-directing unit and the at least one combustion chamber for directing the radiation from the beam-directing unit into the combustion chamber. The apparatus may further comprise at least one photon injector coupled to the at least one combustion chamber for directing the radiation from the laser source into the combustion chamber. The apparatus of the present invention may also include an optical parametric oscillator/laser (OPOL) as the laser source.

The present invention is also directed to a method of controlling a combustion process, comprising the steps of directing the output of a laser source into at least one combustion chamber to initiate combustion of a fuel mixture within the combustion chamber; and controlling the output of the laser source to emit at least one predetermined wavelength of radiation corresponding to a region of absorption of at least one molecule of the fuel mixture, in order to induce a plurality of those molecules into a state of excitation to ignite the fuel mixture.

One embodiment of the present invention further comprises the step of selectively directing the output of at least one laser source into at least one combustion chamber of an internal-combustion engine. The method may further comprise the steps of sensing the rotational position of the internal-combustion engine, and selectively directing the output of the laser source into the combustion chamber based on the rotational position of the engine.

In one embodiment of the present invention, the step of selectively directing the output of the at least one laser source includes transmitting the output of the at least one laser source through a liquid-crystal switch, and adjusting the refractive index of the liquid crystal switch for directing the output to a selected combustion chamber. The method may further comprise the step of transmitting the output of the at least one laser source through a respective photon injector into each combustion chamber.

One advantage of the apparatus and method of the present invention is that the laser source can be tuned to specifically excite certain vibrational states of the molecules of an oxidant/fuel mixture. Because only certain vibrational states are excited, the randomization in the upper-vibrational states is reduced in comparison to prior combustion processes. Accordingly, the distribution of excited states is relatively narrow in comparison to prior combustion systems, and approximately equivalent to that of very high-compression engines, without the attendant pollution problems of such engines. Accordingly, fuel efficiency can be increased without the typical increase in pollutants.

Another advantage of the apparatus and method of the present invention is that given the same number of molecules, the photo-excitation of the fuel mixture should produce substantially more energy in comparison to prior combustion systems because a greater number of the molecules are in an excited state to produce flaggregation. Accordingly, the apparatus and method of the present invention provides a substantially more efficient combustion process, permitting, for example, substantially more efficient, yet more powerful engines.

Yet another advantage of the apparatus and method of the present invention is that they permit the use of an OPOL as the laser source. As a result, the OPOL can be tuned to excite the specific molecules of interest, and thus efficiently initiate the combustion process for any of various fuel mixtures.

Other advantages of the apparatus and method of the present invention will become apparent in view of the following detailed description and accompanying drawings.

DETAILED DESCRIPTION

Figure 1:
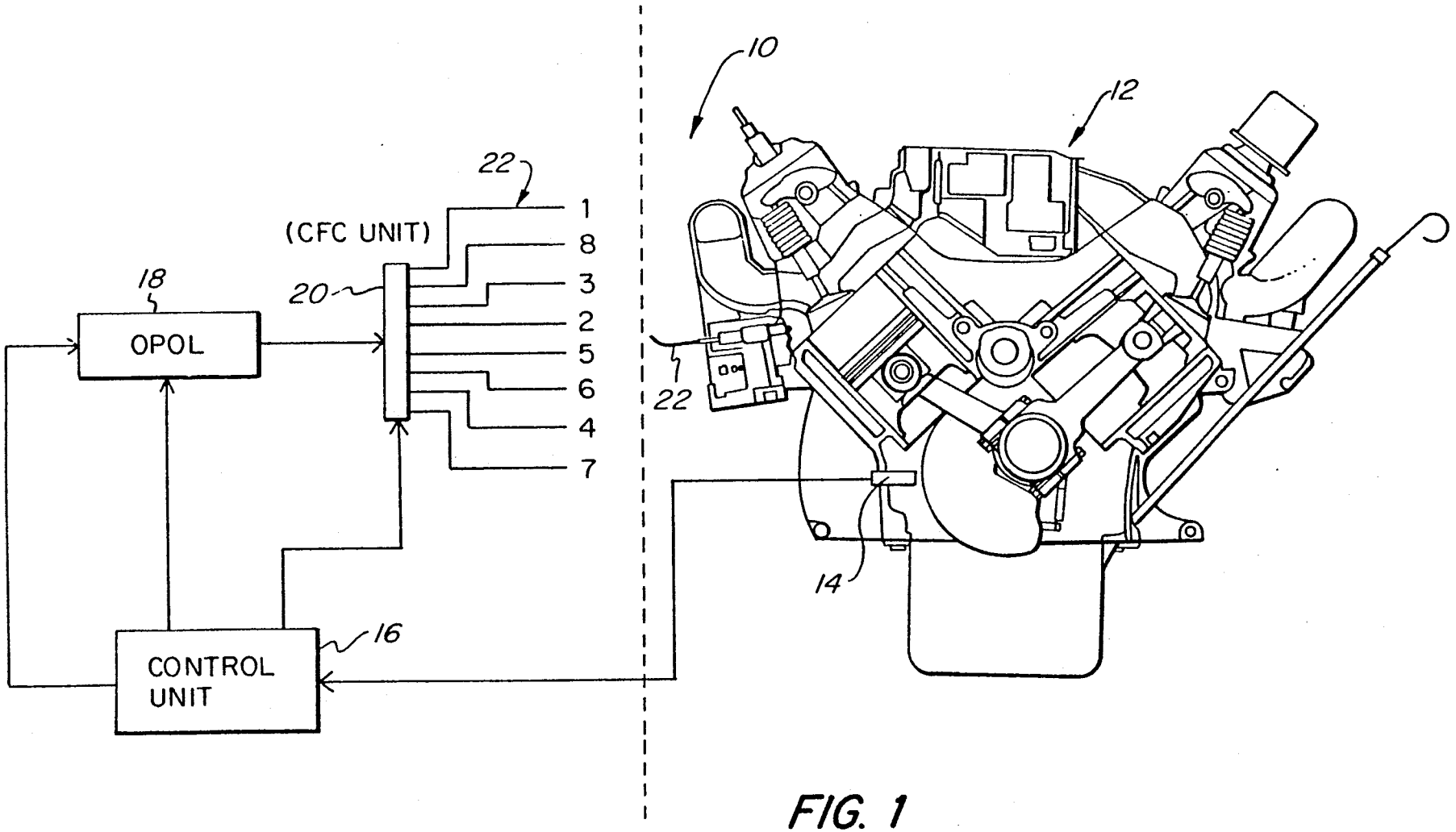
FIG. 1 is a schematic illustration of an apparatus embodying the present invention coupled to a typical internal-combustion engine.

In FIG. 1 an apparatus embodying the present invention is indicated generally by the reference numeral 10. The apparatus 10 is coupled to a typical internal-combustion engine 12 for controlling the combustion process in order to increase the efficiency of the engine. As will be recognized by those skilled in the art, however, the apparatus and method of the present invention are not limited to the particular type of internal-combustion engine illustrated in FIG. 1, but rather can be adapted for controlling the combustion processes of any of numerous types of combustion devices, such as other types of internal-combustion engines, turbines, and furnaces or heating devices.

As shown in FIG. 1, a sensor 14 is coupled to the engine 12 for transmitting electrical signals to a control unit 16 indicative of the position of the crankshaft or of the camshaft of the engine (and thus indicative of the positions of the pistons). The sensor 14 can be any of numerous types of such sensors known to those of ordinary skill in the art, which generates such signals by, for example, optically detecting the position of the crankshaft or camshaft of the engine 12. The control unit 16 is coupled to an optical parametric oscillator/laser (OPOL) 18 and a cylinder-firing-control (CFC) unit 20.

The OPOL 16 can be substantially the same as any of the OPOLs shown and described in co-pending patent application Ser. No. 07/777,705, filed Oct. 15, 1991, entitled "An Internally Stimulated Optical Parametric Oscillator/Laser", now U.S. Pat. No. 5,195,104, which is assigned to the same assignee as the present invention, and is hereby expressly incorporated by reference as part of the present disclosure. The OPOL 16 is constructed to generate secondary (parametrically generated) radiation from monochromatic coherent radiation by means of parametric interaction of the primary radiation with an optically nonlinear medium. The primary radiation has a known frequency, and it propagates through the nonlinear medium and is converted into secondary radiation at two lower frequencies (longer wavelengths). The secondary or parametric radiation has two components, typically referred to as a signal wavelength and an idler wavelength. As will be recognized by those skilled in the art, however, an optical parametric oscillator (OPO) or other suitable laser source can equally be used in the apparatus of the present invention instead of the OPOL 18.

Figure 2:
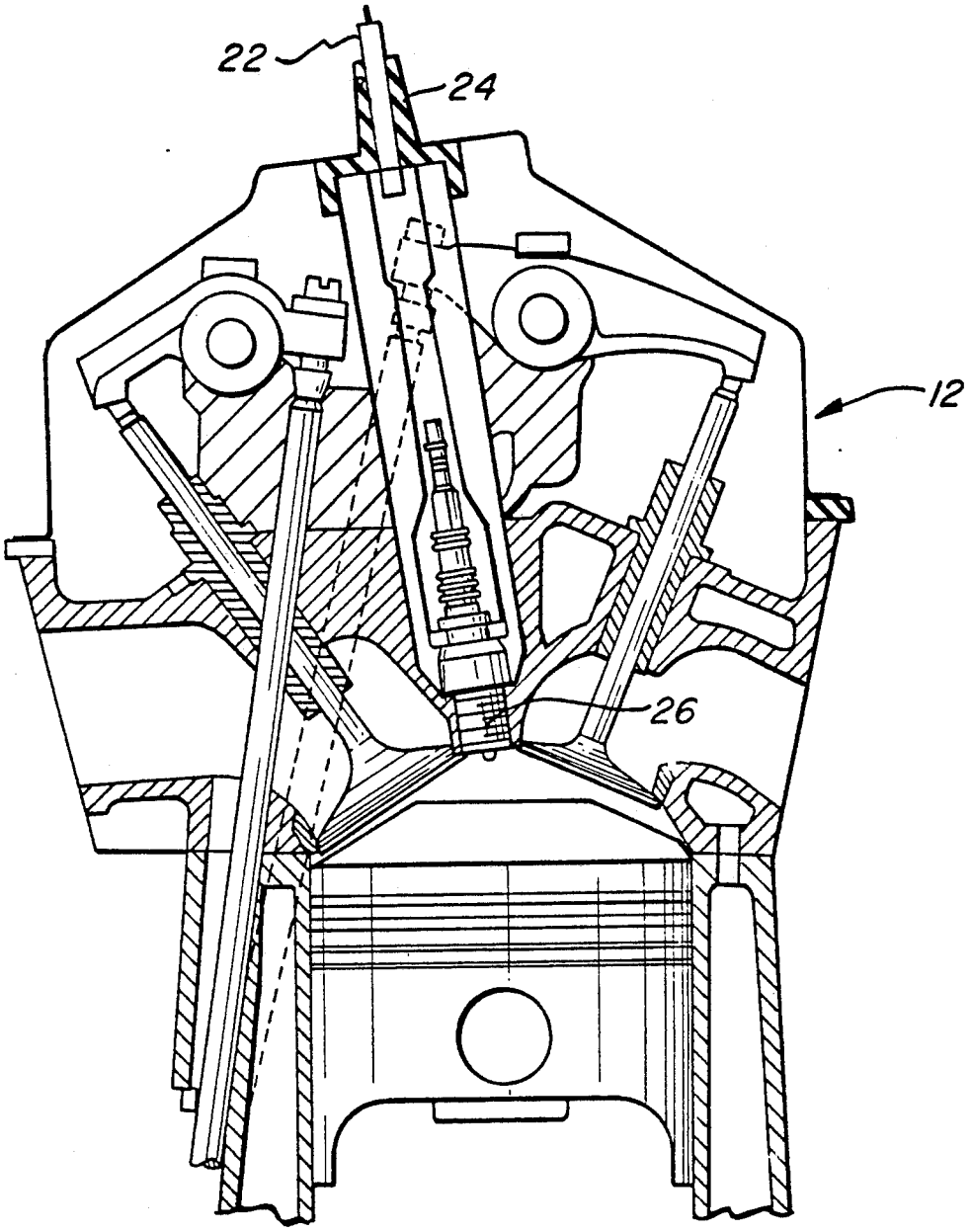
FIG. 2 is a schematic illustration of a typical fiber-optic cable and photon injector of the apparatus of FIG. 1 mounted within the cylinder head of the internal-combustion engine of FIG. 1.

The CFC unit 20 operates in effect like a distributor in a typical internal-combustion engine by directing the photons generated by the OPOL 18 to the respective cylinders of the engine 12 for initiating combustion in each cylinder. The CFC unit 20 includes a plurality of fiber-optic cables 22, each coupled to a respective cylinder of the engine 12, as indicated by the respective designations 1–8 in FIG. 1 (each number corresponding to a respective cylinder of the engine 12). As shown in FIG. 2, each fiber-optic cable 22 is shielded and terminates in a respective metal/ceramic fitting 24 mounted in the cylinder head of the engine 12 above the corresponding cylinder. A corresponding photon injector 26 is mounted in the top of the cylinder for injecting the photons transmitted from the fiber-optic cable 22 into the combustion chamber to initiate the combustion process, as is described further below. The photon injector 26 is preferably formed from silica or sapphire fibers of a type known to those of ordinary skill in the art.

Figure 3:
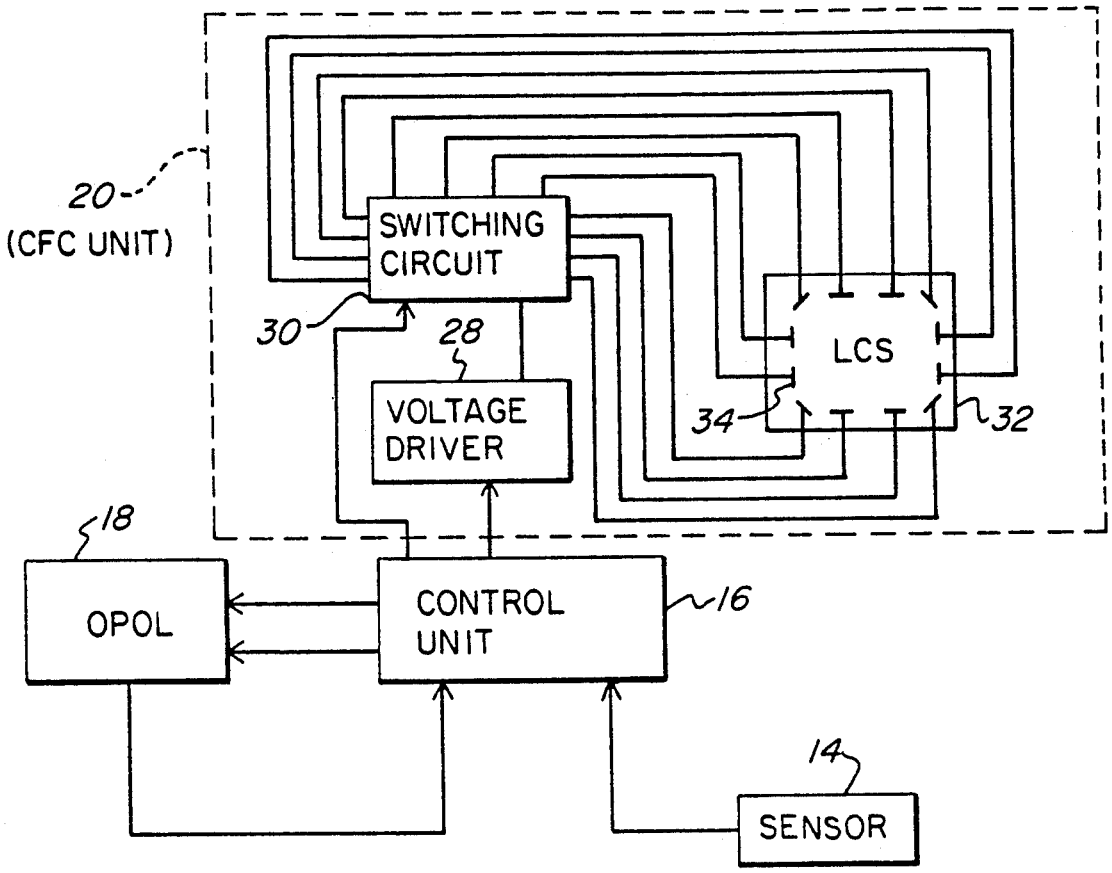
FIG. 3 is a schematic illustration of the apparatus of FIG. 1 illustrating the cylinder-firing-control (CFC) unit in further detail.
Figure 4:
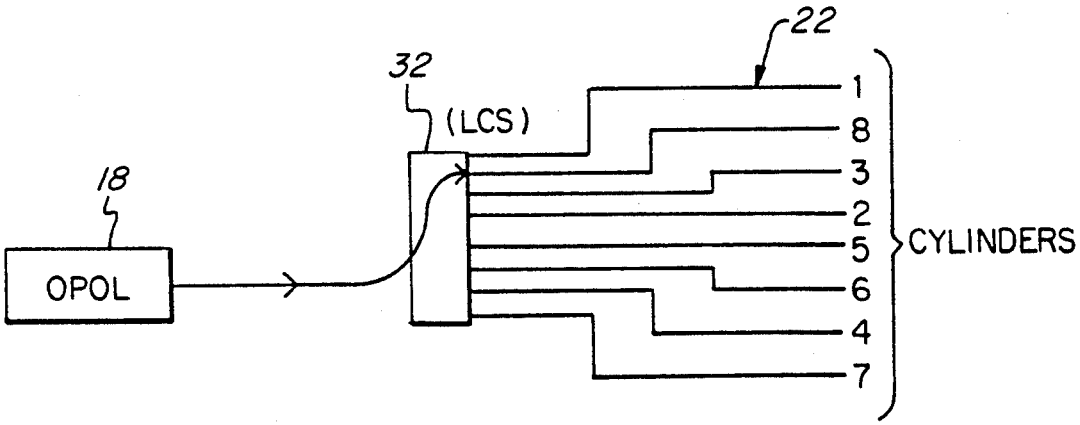
FIG. 4 is a schematic illustration of the OPOL and LCS switch of the apparatus of FIG. 1.

In FIG. 3, the CFC unit 20 is illustrated in further detail and includes a voltage driver 28 coupled to the control unit 16, and a switching circuit 30 coupled to the control unit 16, the voltage driver 28, and a liquid-crystal switch (LCS) 32. As shown in FIG. 4, the LCS 32 is coupled between the output of the OPOL 18 and the fiber-optic cables 22 in order to direct the photons transmitted by the OPOL 18 to a selected fiber-optic cable 22. The control unit 16 transmits a signal to the switching circuit 30 indicative of which cylinder of the engine 12 is to be fired. The switching circuit 30 then directs the voltage from the voltage driver 28 to an appropriate set of electrodes 34 coupled to the LCS 32. As shown in FIG. 3, the electrodes 34 are distributed around the LCS 32. Thus, as the voltage is applied to the selected electrodes 34, the refractive index of the LCS 32 is adjusted to direct the output of the OPOL 18 to the fiber-optic cable 22 coupled to the cylinder to be fired. The LCS 32 is of a type known to those of ordinary skill in the art. As will also be recognized by those skilled in the art, however, other known beam directing optics may equally be used instead of the LCS 32 for directing the output of the OPOL 18 to the selected fiber-optic cables 22, such as a rotating mirror, waveguide optics, bi-refringent controls, or an acousto-optic cell.

In the photo-combustion process of the present invention, the OPOL 18 (or other suitable laser) is tuned to specifically excite certain vibrational states of the molecules of the air/fuel mixture. Thus, because only certain vibrational states are excited, the randomization in the upper-vibrational states is reduced in comparison to prior combustion processes. The exact wavelengths that the OPOL 18 must produce depends on the fuel and the compression ratio of the engine. Thus, one advantage of using an OPOL in the apparatus of the present invention, is that an OPOL can be tuned to efficiently excite each specific molecule of interest.

Figure 5:
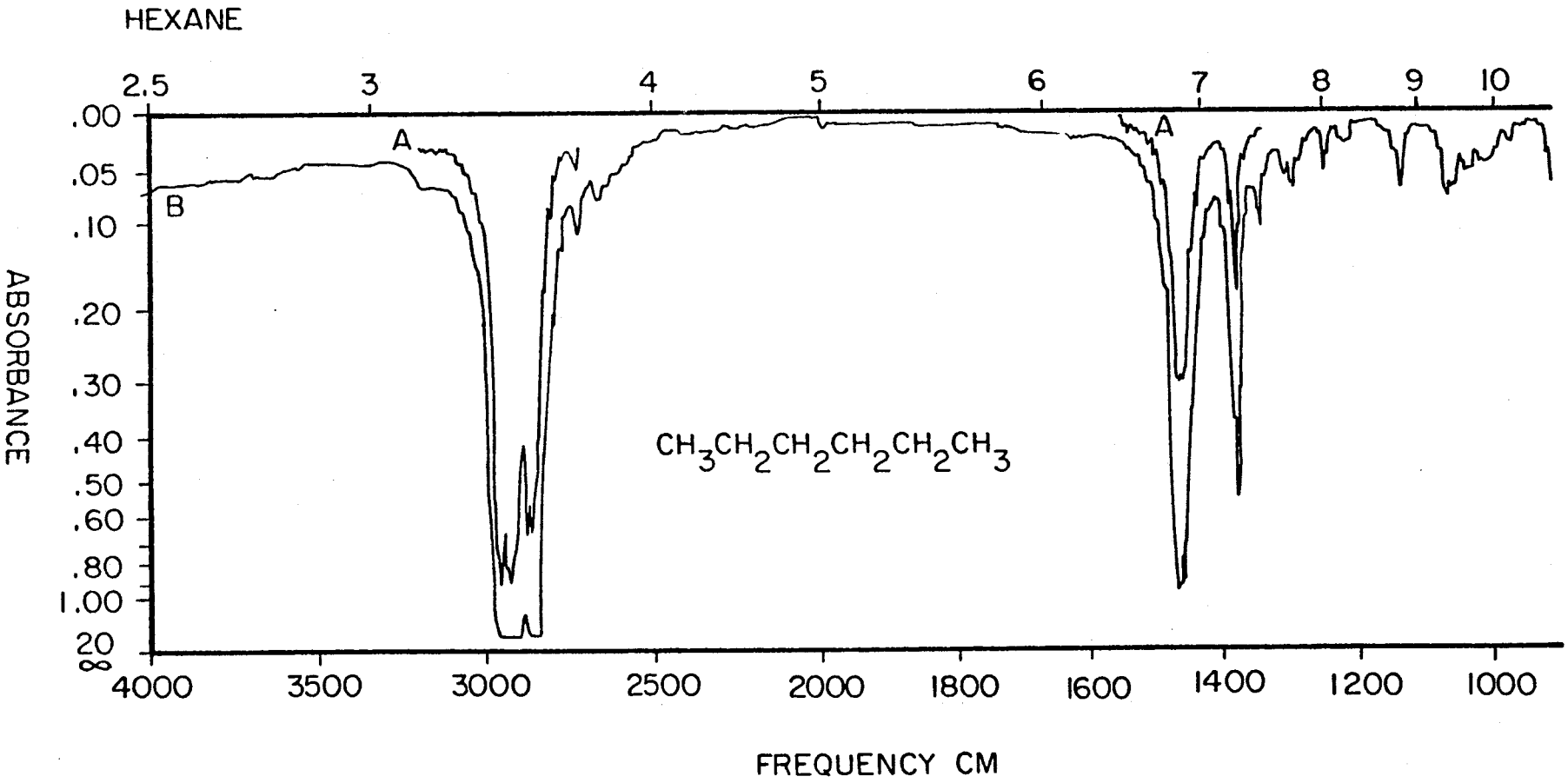
FIG. 5 is a graphic illustration of the absorption spectra of hexane.

For example, current fuels for internal-combustion engines are composed of mixtures of hydrocarbons containing octane, hexane and similar molecules. In this type of system, the fuel, as opposed to the oxidant, is preferably excited by the laser source (e.g., the OPOL 18). In FIG. 5, the absorption spectra of hexane is illustrated. As can be seen, there are two primary regions of absorption ("primary absorption bands"), one is in the approximately 3.0 to 4.0 micron region and the other is in the approximately 6.5 to 7.5 micron region. Thus, in a hexane-based photo-combustion process, the OPOL 18 is tuned to the 3.0 or the 7.0 micron region. As a practical matter, the 3.0 micron region is preferred because there is greater energy per photon and because there is less interference from water absorption. It should also be pointed out that the molecule of interest typically also has absorption overtones. In the case of hexane, the absorption overtone is in the infrared region of approximately 1.6–1.7 microns. This region can also therefore be accessed by a suitable laser source in order to facilitate the combustion process.

Thus, when the OPOL 18 irradiates an air/hexane/fuel mixture at 3.5 microns, this produces rotational and vibrational excitation states similar to excitation states created by compression. However, one advantage of the apparatus and method of the present invention is that because the excitation caused by the radiation of the OPOL 18 (or other suitable laser source) is selective, the distribution of excited states is relatively narrow in comparison to excitation states created by compression. There is thus a significant decrease in the production of $NO_x$ pollutants in comparison to prior compression engines. The distribution of excited states which burns is believed to be approximately equivalent to that of a very high-compression engine, but without the attendant pollution problems of such engines.

In the operation of the apparatus and method of the present invention, the control unit 16 controls the output of the OPOL 18. As the sensor 14 senses the position of the crankshaft (or camshaft), and thus the positions of the pistons, the control unit 16 correspondingly adjusts the wavelength of the OPOL 18 and the rate at which it fires. Depending on the type of fuel used, the burn chemistry of the fuel, and the selected wavelength for the output of the OPOL 18, the OPOL is controlled by the control unit 16 to emit a single wavelength, multi-wavelengths, or a series of wavelengths. The selected wavelength (or wavelengths) depends on the position of the respective piston (as indicated by the sensor 14) and the propagation of the flame front which will cause a change in temperature and pressure within the respective combustion chamber.

The output of the OPOL 18 is directed to the LCS 32, as shown in FIG. 4. The CFC unit 20 also receives a signal from the control unit 16 indicative of which cylinder is to be fired, and sets the switching circuit 30 to the respective cylinder. The switching circuit 30 then directs the voltage from the voltage driver 28 to the corresponding set of electrodes 34 on the LCS 32. As the voltage is applied to the corresponding electrodes 34, the refractive index of the LCS 32 is adjusted so that the output of the OPOL 18 is directed to the fiber-optic cable 22 for the selected cylinder. The output of the OPOL 18 is therefore transmitted through the respective fiber-optic cable 22 and photon injector 26 and into the combustion chamber of the selected cylinder to initiate the combustion process. The resulting change in temperature and pressure upon injection of the photons into the combustion chamber, in addition to various molecular fragments of fuel, creates secondary excited states within the unburnt fuel to sustain combustion. As the crankshaft continues to rotate, this process is repeated for each successive cylinder.

One advantage of the apparatus and method of the present invention is that they can be used with nearly any type of fuel, including gasoline, propane, alcohol, etc., which has an absorption spectra that can be reached using a suitable laser source, such as the OPOL 18. It should also be pointed out that the laser radiation can be used to excite the oxidant, which in most cases is oxygen ($O_2$), as opposed to the fuel as described above. The absorption spectra of oxygen is in the ultraviolet region, however, and therefore with current laser sources it is more practical to photo-excite the hydrocarbons as opposed to the oxidant.

Another advantage of the apparatus and method of the present invention is that upon initiation of combustion, the unburnt fuel can then be excited directly by the OPOL 18, or the OPOL 18 can be tuned to excite the secondary by-products which in turn act as an energy transfer mechanism to the unburnt fuel. Yet another advantage of the present invention is that the output of the OPOL 18 can be tuned to further burn the fuel by-products or photo-dissociate such by-products to produce the desired exhaust components in order to reduce pollutant emissions.

Figure 6B:
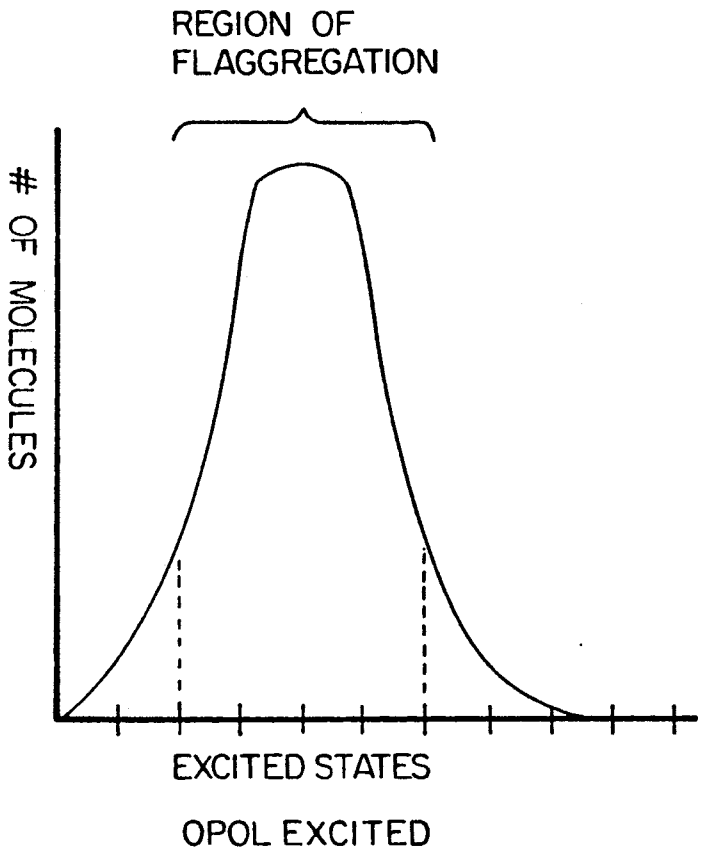
FIGS. 6A and 6B are graphic illustrations of typical upper-excited states of an air/fuel mixture, comparing an OPOL-excited state in accordance with the present invention, to a compression-excited state.
Figure 6A:
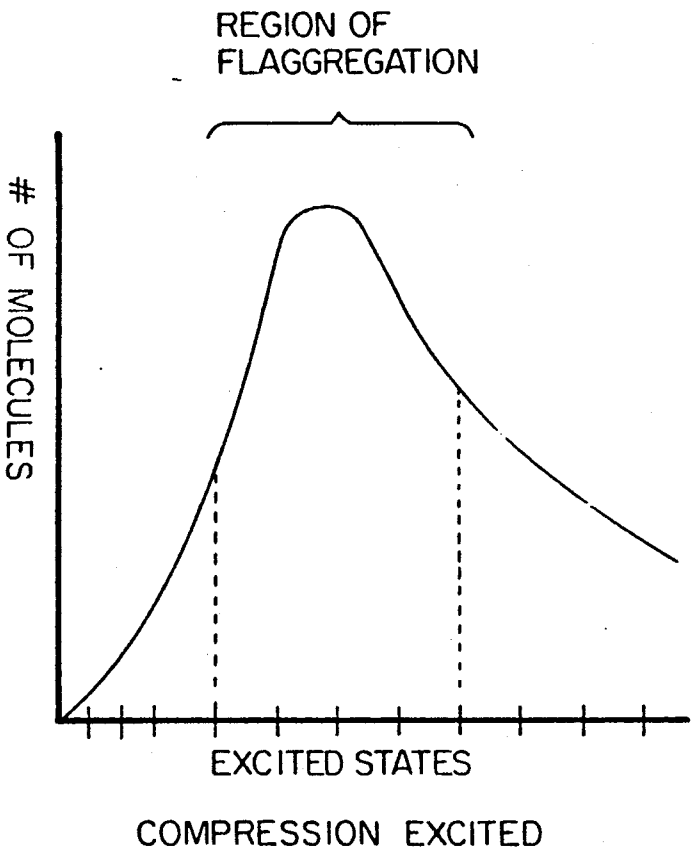

FIGS. 6A and 6B are graphic illustrations of typical upper-excited states of an air/fuel mixture. FIG. 6A illustrates a typical air/fuel mixture when compressed in a compression cycle and, as can be seen, there is a Boltzmann distribution of excited states. Thus, a maximum of only approximately 30% of the molecules are believed to be in a suitably excited state to react with the oxygen present and sustain flaggregation. FIG. 6B, on the other hand, illustrates a typical air/fuel mixture when photo-excited in accordance with the present invention and, as can be seen, there is a Gaussian distribution of excited states. Thus, one advantage of the apparatus and method of the present invention is that given the same number of molecules, the photo-excitation of the air/fuel mixture should produce substantially more energy in comparison to prior combustion systems because a greater number of the molecules are in an excited state to produce flaggregation. The apparatus and method of the present invention can therefore typically achieve significantly better fuel efficiency than prior combustion engines.

Another advantage of the apparatus and method of the present invention is that the distribution of the excited states of the molecules of the air/fuel mixture, and therefore the burn characteristics, are more nearly identical for each successive piston stroke in comparison to prior combustion systems. Accordingly, with the apparatus and method of the present invention, the fuel should burn more evenly, with the resultant extraction of energy being more smooth and efficient in comparison to prior combustion systems.

Another advantage of the apparatus and method of the present invention is that with the exception of the sensor 14 and photon injector 26, the other components of the system can be located away from the engine, e.g., in or more near the passenger compartment of an automobile, or within the wing of an aircraft when used on an aircraft engine, in order to minimize the exposure of the OPOL 18 (or other suitable laser source) and the associated electronics to the harsh engine environment, and thus increase the durability of the system.

I claim:

1. An apparatus for controlling a combustion process comprising:

a laser source including an output coupled to at least one combustion chamber for directing radiating into the at least one combustion chamber to induce molecular excitation of a fuel mixture prior to ignition of the fuel mixture within the combustion chamber; and a control unit coupled to the laser source and controlling an output of the laser source to emit at least one predetermined wavelength of radiation within an absorption band of at least one molecule of the fuel mixture which induces a plurality of the at least one molecules into a state of rotational and vibrational excitation prior to ignition of the fuel mixture.

2. An apparatus as defined in claim 1, further comprising a beam-directing unit coupled between the output of the laser source and the at least one combustion chamber for directing the radiation into the at least one combustion chamber.

3. An apparatus as defined in claim 2, further comprising at least one fiber-optic cable coupled between the beam-directing unit and the at least one combustion chamber for directing the radiation from the beam-directing unit into the combustion chamber.

4. An apparatus as defined in 1, wherein the laser source is coupled to at least one combustion chamber of an internal-combustion engine.

5. An apparatus as defined in claim 4, further comprising a beam-directing device coupled between the output of the laser source and at least one combustion chamber of the internal-combustion engine for directing the radiation into the at least one combustion chamber.

6. An apparatus as defined in claim 5, further comprising at least one fiber-optic cable coupled between the beam-directing device and at least one combustion chamber for directing the radiation from the beam-directing device into the at least one combustion chamber.

7. An apparatus as defined in claim 4, further comprising at least one photon injector coupled to the at least one combustion chamber for directing the radiation from the laser source into the combustion chamber.

8. An apparatus as defined in claim 1, wherein the laser source includes an optical parametric oscillator/-laser.

9. An apparatus as defined in claim 4, further comprising at least one sensor coupled to the internal-combustion engine for transmitting signals to the control unit indicative of the position of at least one piston of the engine, the control unit being responsive to the signals to control the output of the laser source.

10. An apparatus as defined in claim 9, wherein the at least one sensor transmits signals based on the position of at least one of a crankshaft and a camshaft of the internal-combustion engine.

11. An apparatus as defined in claim 1, wherein the control unit controls the output of the laser source to emit a first predetermined wavelength within a primary absorption band of at least one molecule of the fuel mixture and to emit a second predetermined wavelength within a molecular overtone of the at least one molecule of the fuel mixture.

12. An apparatus as defined in claim 11, wherein the fuel mixture includes a hydrocarbon fuel, and the first predetermined wavelength is within a range selected from the group including i) approximately 3 to 4 microns and ii) approximately 6.5 to 7.5 microns, and the second predetermined wavelength is within the range of approximately 1.6 to 1.7 microns.

13. An apparatus for controlling a combustion process comprising:

a laser source including an output coupled to at least one combustion chamber for directing radiation into the at least one combustion chamber to initiate combustion of a fuel mixture within the combustion chamber;

a control unit coupled to the laser source for controlling an output of the laser source to emit at least one predetermined wavelength of radiation corresponding to a region of absorption of at least one molecule of the fuel mixture to induce a plurality of the at least one molecules into a state of excitation to ignite the fuel mixture; and a beam-directing unit coupled between the output of the laser source and the at least one combustion chamber for directing the radiation into the at least one combustion chamber, wherein the apparatus is coupled to a plurality of combustion chambers and the beam-directing unit includes a liquid-crystal switch for directing the radiation to a selected combustion chamber by adjusting the refractive index of the liquid-crystal switch.

14. An apparatus as defined in claim 13, wherein the liquid-crystal switch includes a plurality of electrodes and the refractive index of the liquid-crystal switch is adjusted by directing a voltage to a predetermined set of electrodes.

15. An apparatus as defined in claim 14, further comprising a switching circuit coupled between the control unit and the liquid-crystal switch for directing the voltage to the predetermined set of electrodes.

16. An apparatus as defined in claim 14, further comprising a voltage driver for supplying the voltage to the predetermined set of electrodes.

17. A method of controlling a combustion process comprising the steps of:

directing the output of at least one laser source into at least one combustion chamber to induce molecular excitation of a fuel mixture within the combustion chamber prior to initiating combustion of the fuel mixture; and controlling the output of the at least one laser source to emit at least one predetermined wavelength of radiation within an absorption band of at least one molecule of the fuel mixture inducing a plurality of the at least one molecules into a state of rotational and vibrational excitation prior to ignition of the fuel mixture.

18. A method as defined in claim 17, further comprising the step of selectively directing the output of the at least one laser source into at least one combustion chamber of an internal-combustion engine.

19. A method as defined in claim 18, further comprising the steps of sensing the rotational position of the internal-combustion engine, and selectively directing the output of the at least one laser source into the at least one combustion chamber based on the rotational position of the internal-combustion engine.

20. A method as defined in claim 18, further comprising the step of transmitting the output of the at least one laser source through a respective photon injector into the at least one combustion chamber.

21. A method as defined in claim 17, wherein the at least one molecule induced into a state of excitation is a fuel molecule.

22. A method as defined in claim 17, wherein the at least one molecule induced into a state of excitation is an oxidant molecule.

23. A method as defined in claim 18, further comprising the step of further controlling the output of the at least one laser source to further burn the fuel by-products to produce desired exhaust components for reducing pollutant emissions.

24. A method as defined in claim 17, comprising the step of controlling the output of the laser source to emit a first predetermined wavelength within a primary absorption band of at least one molecule of the fuel mixture and to emit a second predetermined wavelength within an absorption overtone of the at least one molecule of the fuel mixture.

25. A method as defined in claim 24, wherein the fuel mixture includes a hydrocarbon fuel, and the first predetermined wavelength is within a range selected from the group including i) approximately 3 to 4 microns and ii) approximately 6.5 to 7.5 microns, and the second predetermined wavelength is within the range of approximately 1.6 to 1.7 microns.

26. A method of controlling a combustion process comprising the steps of:

directing the output of at least one laser source into at least one combustion chamber to initiate combustion of a fuel mixture within the combustion chamber;

controlling the output of the at least one laser source to emit at least one predetermined wavelength of radiation corresponding to a region of absorption of at least one molecule of the fuel mixture to induce a plurality of the at least one molecules into a state of excitation to ignite the fuel mixture; and selectively directing the output of the at least one laser source into at least one combustion chamber of an internal-combustion engine by transmitting the output of the at least one laser source through a liquid-crystal switch and adjusting the refractive index of the liquid crystal switch for directing the output to at least one combustion chamber.

27. A method of controlling a combustion process, comprising the following steps:

directing the output of a laser source into a hydrocarbon fuel to induce rotational and vibrational molecular excitation of the fuel prior to initiating combustion of the fuel; and controlling the output of the laser source to emit a first wavelength of radiation greater than approximately 1.5 microns and within an absorption band of at least one molecule of the hydrocarbon fuel inducing a plurality of the at least one molecules into a state of rotational and vibrational excitation prior to ignition of the hydrocarbon fuel.

28. A method as defined in claim 27, comprising the step of controlling the output of the laser source to emit a first wavelength within a primary absorption band of at least one molecule of the hydrocarbon fuel, and a second wavelength within an absorption overtone of the at least one molecule of the hydrocarbon fuel.

29. A method as defined in claim 28, wherein the first wavelength is within a range selected from the group including i) approximately 3 to 4 microns and ii) approximately 6.5 to 7.5 microns, and the second wavelength is within the range of approximately 1.6 to 1.7 microns.

30. A method as defined in claim 27, wherein the laser source is an optical parametric oscillator/laser.

31. An apparatus for controlling a combustion process, comprising:

a laser source including an output coupled to a plurality of combustion chambers for directing radiation into the combustion chambers to initiate combustion of a fuel mixture within the combustion chambers;

a control unit coupled to the laser source for controlling an output of the laser source to emit at least one wavelength of radiation; and a liquid-crystal switch coupled to the output of the laser source for directing the radiation to a selected combustion chamber by adjusting the refractive index of the liquid-crystal switch.

* * * * *